United States Patent [19]

Bratthäll et al.

[11] 4,098,332

[45] Jul. 4, 1978

[54] FINNED TUBE HEAT EXCHANGER CONSTRUCTION

[75] Inventors: Lars Bratthäll, Linköping; Bernt Lindström, Karlskoga, both of Sweden

[73] Assignee: Stal-Laval Apparat AB, Linköping, Sweden

[21] Appl. No.: 738,085

[22] Filed: Nov. 2, 1976

[30] Foreign Application Priority Data

Nov. 4, 1975 [SE] Sweden ..... 7512303

[51] Int. Cl.[2] ..... F28F 9/00; F28F 1/36

[52] U.S. Cl. ..... 165/172; 165/178; 248/68 CB

[58] Field of Search ..... 165/DIG. 13, 172, 178, 165/162; 248/68 CB

[56] References Cited

U.S. PATENT DOCUMENTS

| | | | |
|---|---|---|---|
| 1,704,097 | 3/1929 | Muhleisen | 165/172 |
| 2,021,117 | 11/1935 | Lucke | 165/172 |
| 2,402,209 | 6/1946 | Ryder | 165/172 |
| 3,998,268 | 12/1976 | Sagan | 165/172 |

FOREIGN PATENT DOCUMENTS

| | | | |
|---|---|---|---|
| 1,599,502 | 8/1970 | France | 165/162 |

*Primary Examiner*—Charles J. Myhre
*Assistant Examiner*—Sheldon Richter
*Attorney, Agent, or Firm*—Kenyon & Kenyon, Reilly, Carr & Chapin

[57] ABSTRACT

A plurality of mutually parallel finned tubes forming a heat exchanger are positioned so closely together that the peripheries of mutually oppositely extending segments of the tube's respective fins are not substantially interspaced. To support the finned tubes, one or more groups of those segments are shortened to form transverse passages through which tube support members are passed transversely with respect to the tubes.

3 Claims, 5 Drawing Figures

Fig.1
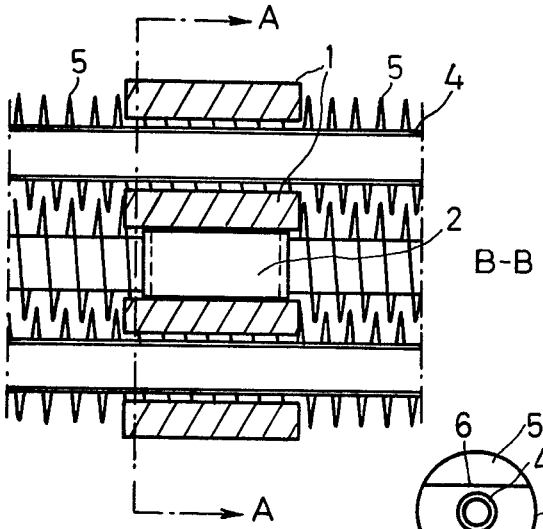
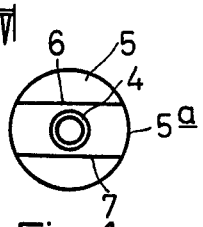
Fig. 1a
Fig.2
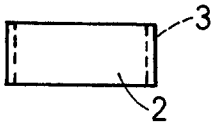
Fig. 2a
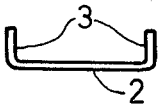
Fig.3
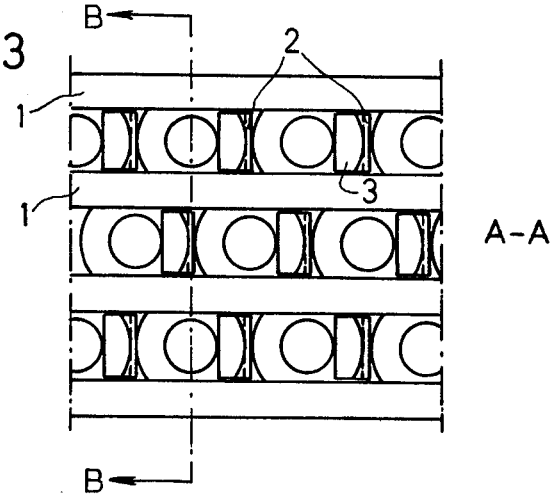

FINNED TUBE HEAT EXCHANGER CONSTRUCTION

BACKGROUND OF THE INVENTION

Waste gases from gas turbines, metallurgical furnaces and the like, are used to heat water. For this purpose metal finned tube heat exchangers are used, the hot gases flowing over the tubes and through the tube fins and water flowing through the insides of the tubes. Such heat exchangers may also be used for other applications.

For high heat conductivity, the fins are integrally fixed to the tubes by the finned tube manufacturer. For efficiency the finned tubes are positioned parallel to each other, desirably as closely together as possible, when assembled to form a heat exchanger.

The finned tube lengths and service conditions of such a heat exchanger require the finned tubes to be laterally stayed or supported relative to each other between the ends of the tubes. Conventionally this is done by using metal plates having holes with diameters just slightly larger than the fin diameters of the finned tubes, the latter being pushed through these holes so that the plates provide the required lateral support. For strength and rigidity there must be a substantial amount of metal remaining between adjacent holes of the plate, therefore requiring the tubes to be substantially interspaced and preventing the finned tubes from being interspaced as closely together as would otherwise be possible; in other words, as closely together as the oppositely extending fin segments of adjacent tubes permit.

Such stay or support plates must be interspaced along the lengths of the finned tubes. They have the disadvantages of undesirably restraining thermal expansion and contraction of the finned tubes and of preventing the tubes from being positioned as closely together as is desirable in the interest of efficiency.

SUMMARY OF THE INVENTION

According to the present invention, where staying or support is required, one or a group of the oppositely extending segments of the respective fins of adjacently positioned tubes are shortened and possibly eliminated so that transverse passages are formed between the various mutually adjacent tubes and through which tube support members, such as metal bars, are passed transversely with respect to the tubes. This makes it possible to position the tubes so closely together that the peripheries of oppositely extending segments of their respective fins are not substantially interspaced and may possibly touch or overlap.

The tube fin segments can be shortened or cut in any convenient way, as exemplified by grinding or machining away the fin metal. Only the normally interfering fin segments need be shortened, leaving the balance of the fins untouched.

When the finned tubes are bundled to form row after row of the tubes with the stay bars extending transversely through passages formed as described, the tubes are not inherently also supported against displacement in the longitudinal direction of the stay bars.

Therefore, the present invention provides spacers positioned between tubes which are adjacent to each other in the longitudinal direction of the stay bars. These spacers are in the form of U-shaped sheet metal elements having webs engaged by the uncut fin portions of one tube remaining after the described fin segment shortening and having flanges which extend between the uncut fin portions of the adjacent tube and into contact with its unfinned tube wall located between its fins.

BRIEF DESCRIPTION OF THE DRAWINGS

A specific example of this invention is schematically illustrated by the accompanying drawings in which:

FIG. 1 is a vertical section taken through three layers of a finned tube bundle type heat exchanger, this section being taken on the line B—B in FIG. 3;

FIG. 1*a* is a cross section taken through one of the finned tubes and showing the fin segment shortening used to form the transverse passage;

FIG. 2 is a side view of one of the sheet metal spacers;

FIG. 2*a* is an end view of FIG. 2; and

FIG. 3 is a section taken on the line A—A in FIG. 1.

DETAILED DESCRIPTION OF THE INVENTION

Referring to the above drawings, flat metal stay bars 1 of rectangular cross section are used in the case of this example, in conjunction with the sheet metal spacers having the webs 2 and flanges 3.

The metal finned tubes are shown with their solid metal tube walls 4 and encircled by a continuous series of radially extending interspaced fins 5. These fins are integrally attached to the tubes 4, the series of fins extending longitudinally along the tubes. The series of fins are shown as being formed by the convolutions of helical fins.

As shown by FIG. 1 in particular, the tubes are positioned so closely together that the fins of adjacent tubes overlap slightly. As shown by FIG. 1*a*, to form rectangular passages for the transversely extending rectangular stay bars 1, the interfering segments of the fins are removed as shown at 6. In other words, the segments of the fins which extend towards each other from adjacent tubes are shortened or possibly eliminated, while leaving an unremoved balance as shown at 5*a* in FIG. 1*a*. In this figure one of the uncut fins 5 can be seen behind one of the fins from which the interfering segments has been removed to form the flat surface 6. The flat surfaces 6 of a group of the fins of any two adjacent tubes form transverse passages of rectangular contour fitting the contours of the bars 1. Any two of the flat surfaces 6 are parallel to each other.

FIGS. 1 and 3 show that the finned tubes can be made into a bundle formed by horizontal layers of the tubes with each layer separated and vertically positioned by the rectangular metal stay bars 1, FIG. 1 showing that the tubes can be positioned so closely together vertically that the fins of one tube slightly overlap the fins of the next tube.

To interspace the tubes of each layer the spacers are used. As shown in FIG. 3, the webs 2 of the spacers contact the uncut segments 5*a* of the tube fins, while the flanges or legs 3 of the spacers extend between the uncut segments 5*a* of the next adjacent tubes and contact the peripheries of the tubes 4 of the finned tubes. In this way the finned tubes are interspaced as to each layer. Because the spacers are made of sheet metal the segments 5*a* of the various adjacent tubes are separated only by the thickness of the thin sheet metal webs 2 of the various spacers.

To form each of the passages for the stay bars 1, groups of the fins which project in opposite directions at mutually opposite locations from the opposite tubes are segmentally shortened so that the remaining portions of the fins form a plurality of contacts with the surfaces of the flat rectangular stay bars 1. This provides a plurality of easily slidable contacts permitting the finned tubes to thermally expand and contract longitudinally without substantial restraint.

Although the drawings illustrate the formation of only one set of rectangular passages with only one of the bars 1 passing through each passage, it is to be understood that the construction described can be used to any extent, the number of stayed locations depending on the lengths of the finned tubes and the service conditions to be expected. It is possible to make a large heat exchanger less expensively than has heretofore been possible, having the finned tubes bundled very closely together, and which is strong and rugged.

What is claimed is:

1. A heat exchanger comprising at least two tubes each encircled by a substantially continuous series of radially extending interspaced fins attached to the tube, the series extending longitudinally along the tube, said tubes being positioned closely together so that the peripheries of oppositely extending segments of their respective fins are not substantially interspaced, at least one of said segments of one of said fins being radially at least shortened to form a transverse passage between the tubes and through which a tube support member may be transversely passed, said one of said fins having at least one unshortened segment.

2. The heat exchanger of claim 1 in which a group of said segments of the fins of each tube are respectively radially at least shortened at mutually opposite locations of the two tubes and without shortening of the balance of the fins of said group so that said passage has a substantially rectangular cross sectional contour transversely with respect to the tubes, and a tube support member having a substantially corresponding rectangular contour is passed through said passage.

3. The heat exchanger of claim 2 having a tube bundle formed by a plurality of layers of said two tubes with the layers interspaced by a plurality of said tube support members transversely passed through said passages respectively formed between each of the two tubes, each two mutually adjacent tubes of each layer having oppositely extending unshortened segments of their fins forming mutually adjacent peripheries and said adjacent tubes being interspaced by spacers having webs extending transversely between said adjacent peripheries and flanges which transversely extend from the webs into peripheral contact with one of the adjacent tubes by passage between its fins.

* * * * *